US005140834A

United States Patent [19]

Kashiwagi et al.

[11] Patent Number: 5,140,834

[45] Date of Patent: Aug. 25, 1992

[54] DEVICE FOR AUTOMATIC ADJUSTMENT OF DIE HEIGHT OF A PRESS

[75] Inventors: Shigenori Kashiwagi, Sagamihara; Naomi Sato, Kamimikawa; Yasuo Kitamura, Tokyo, all of Japan

[73] Assignees: Aida Engineering, Ltd., Sagamihara; Honda Giken Kogyo Kabushiki Kaisha, Tokyo, both of Japan

[21] Appl. No.: 599,801

[22] Filed: Oct. 19, 1990

[30] Foreign Application Priority Data

Oct. 19, 1989 [JP] Japan ..... 1-272344

[51] Int. Cl.[5] ..... B21J 9/20

[52] U.S. Cl. ..... 72/21; 72/24; 72/441; 72/446; 100/257

[58] Field of Search ..... 72/21, 24, 441, 446; 100/257

[56] References Cited

U.S. PATENT DOCUMENTS 4,386,304 5/1983 Bergmann et al. ..... 100/257
5,027,631 7/1991 Naito ..... 72/21

FOREIGN PATENT DOCUMENTS 0007440 1/1984 Japan ..... 72/21
0238499 10/1986 Japan ..... 100/257
1011314 4/1983 U.S.S.R. ..... 72/21

*Primary Examiner*—David Jones
*Attorney, Agent, or Firm*—Steven M. Rabin

[57] ABSTRACT

A device for automatically adjusting die height in a press having a plurality of dies aligned in a work transfer direction includes a load pattern setting member for inputting possible load patterns, each pattern corresponding to the number of dies under load. A correction setting member is provided for inputting an amount of correction (compensation) by which the position of the bottom of the slide in each load pattern is rectified to a basic position corresponding to a basic load pattern. A pattern identifier is provided for identifying the current load pattern when the slide is at a given position. A correction controller is provided for selecting the proper amount of correction of the position of the bottom of the slide for the identified load pattern and sending a drive control signal corresponding to this amount to a slide position adjustment unit. A slide adjustment actuator is provided for actuating the unit to automatically rectify the position of the bottom of the slide at the bottom dead center of the press cycle to the basic position.

10 Claims, 4 Drawing Sheets

DEVICE FOR AUTOMATIC ADJUSTMENT OF DIE HEIGHT OF A PRESS

REFERENCE TO RELATED APPLICATION

This application claims the priority of Japanese Application Serial No. 1-272344 filed Oct. 19, 1989.

BACKGROUND OF THE INVENTION

The invention relates to a device for automatically adjusting the die height of a press having plural dies.

FIG. 5 shows a conventional device for automatically adjusting a slide of a press. In the drawing, a connecting rod 1 is connected to a crank portion of a press crankshaft (not shown). A slide point portion 3 of the press links the connecting rod 1 to a slide 8. At the slide point portion 3, there is provided a ball or wrist pin, not shown. The connecting rod 1 and the slide point portion 3 are adjustably connected by an adjustment screw 4 which is rotated by a worm wheel 5 and a worm gear 6 to adjust the axial spacing of the connecting rod 1 and the slide 8.

The worm gear 6 is rotated by a drive shaft 12*a*, which is connected to a deceleration motor 11. A slide position adjustment unit 20 comprises a slide position setting element or means 21, a down controller 22, a slide adjustment actuator (e.g. button means) 23*a*, an up controller 24 and a change-over element or means 25 by which the controllers 22, 24 are selected.

A device 9 for confirming that the slide 8 has reached an upper limit is formed as a limit switch which operates when it contacts an operator member 7 projecting upward from the slide point portion 3. The device 9 operates the up controller 24 to stop the ascending slide (closing) 8 at the upper limit. The device 9 responds to actuation of its limit switch to send a signal (SPS) to the up controller 24. A device 10 for confirming that the slide 8 has reached a lower limit is also formed as a limit switch and operates when it contacts another operator member 7*a* projecting downward from the slide point portion 3, and this device 10 is adapted to operate the down controller 22 to stop the descending slide 8 at the lower limit. The device 10 responds to actuation (closing) of its limit switch to send a signal (SPS) to the down controller 22.

When the limit switch of the device 9 or 10 is closed and sends the signal (SPS), the slide 8 is stopped by the controller 22 or 24 at either the upper limit or the lower limit, respectively.

Then, if the slide adjustment button means 23*a* is turned ON (actuated), the controller 22 or 24 operates based on the value (die height) set in the slide position setting means 21 (which may be formed as a digital switch), thereby automatically stopping the slide 8 at a position corresponding to the set die height.

A detector 26 for detecting the current (instantaneous) slide position, or a multi-rotating absolute encoder, is adapted to rotate by a drive shaft 12*b* via a gear mechanism 13 which includes gears 13*a* and 13*b*. The detector 26 comprises a reversible counter, a display, and a switch mechanism, and it digitally displays the instantaneous slide position. The switch mechanism, in accordance with Article 3i of the Japanese standards for structure of power press machines, sends signals HLS and LLS to prevent the slide from going beyond the upper and lower limits, respectively. Each signal is emitted upon closing of the upper or lower limit setting means incorporated in the switch mechanism.

The automatic slide adjustment device according to the prior art has the above-described sophisticated construction. However, it cannot satisfy current demands for diversification in forms of production, automatic speed-up and highly precise production in the case of manufacturing various products in small quantities by one press machine or in the case of forming large products.

According to the prior art, generally while the press is stopped, the slide is moved up and down for adjustment to the die height desired during the continuous running of the press. However, in a press having a number of dies disposed in a direction of transfer of the workpieces through the press, a so-called transfer press, the change in the number of dies under load will inevitably cause elongation of the press frame including the column, thereby changing the die height at bottom dead center. Thus, the workpieces formed by the prior art press machine during its initial operation, i.e. during the transition from the start of operation to the continuous running condition while the number of dies under load is continuously changing, those articles formed just prior to the end of the operation, i.e during the transition from the continuous running condition to completion, are treated as defective products. Thus, the prior art not only causes waste and therefore a high production cost but also creates an obstacle to a speed-up of the operation due to its long starting and ending periods. These disadvantages are particularly serious problems for a large press having many dies.

It may be possible to adjust the slide manually each time there is a change in the number of dies under load during successive press cycles of the starting and completion operations. However, because the correct operation of the slide position setting means 21 must rely upon the human operator's memory, the prior art is not only complicated in operation but also likely to cause human error such as a simple mistake in identifying and inputting data relating to the dies in use, thereby possibly resulting in a failure of the dies.

SUMMARY OF THE INVENTION

An object of the invention is to provide a device for automatically adjusting the die height for a press which, by merely operating the slide adjustment button means when the slide is at a given position, can automatically adjust the slide position in accordance with changes in the number of dies under load so as to assure that the die height at bottom dead center is always the same irrespective of changes in load pattern, thereby producing articles of a required accuracy.

A device for automatically adjusting die height in a press having a plurality of dies aligned in a work transfer direction according to the invention includes a load pattern setting means for setting (inputting) possible load patterns, each pattern corresponding to the number of dies under load. A correction setting means is provided for setting an amount of correction (compensation) by which the position of the bottom of the slide in each load pattern input by the load pattern setting means is rectified to a basic slide bottom position corresponding to a basic load pattern. A pattern identification means is provided for identifying the actual load pattern at the given slide position with one of the possible load patterns set by the load pattern setting means. A correction control means is provided for selecting the proper amount of correction of the position of the bottom of the slide at bottom dead center of the press cycle, for the identified load pattern, and sending a drive control signal corresponding to this amount to a slide position adjustment unit. A slide adjustment actuator is provided for actuating the unit to automatically rectify the position of the bottom of the slide at the bottom dead center of the press cycle to the basic slide bottom position, for the identified load pattern. In the above constructed device according to the invention, the load pattern defined by the number of dies under load and the amount of correction for rectifying the position of the bottom of the slide in each possible load pattern to the basic position are predetermined, the load pattern being set (input) by the pattern setting means while the amount of correction is set by the correction setting means.

If the press is started and then stopped to locate the slide at the given position (for example, the top dead center), the pattern identification means then operates to identify the load pattern. Subsequently, upon operating the press adjustment button means, the correction control means emits a signal corresponding to the amount of correction to the slide position adjustment unit, based on the identified load pattern.

Thus, even if the number of dies under die changes during the starting or stopping operation, the position of the bottom of the slide is always adjusted automatically to the basic position regardless of the load pattern, simply by alternately repeating the one-process operation (one cycle) of the press and the operation of the press adjustment button means. Consequently, it is possible to always make the die height at the bottom dead center constant by fixing the basic position at a given die height.

In summary, the invention comprises a load pattern setting means, a correction setting means, a pattern identification means and a correction control means, wherein the press start button and the slide adjustment button are only pushed reciprocally, whereby the slide adjustment device makes constant the position of the bottom of the slide at the bottom dead center for each load pattern. Thus, the invention can form workpieces at any time in a precise manner and with reduced production cost. The invention is most suitable for speedily producing various articles in a small quantity.

BRIEF DESCRIPTION OF THE DRAWINGS

These and other features and advantages of the invention will be further understood from the following detailed description of the preferred embodiments with reference to the accompanying drawings in which.

DESCRIPTION OF THE PREFERRED EMBODIMENT

Figure 1:
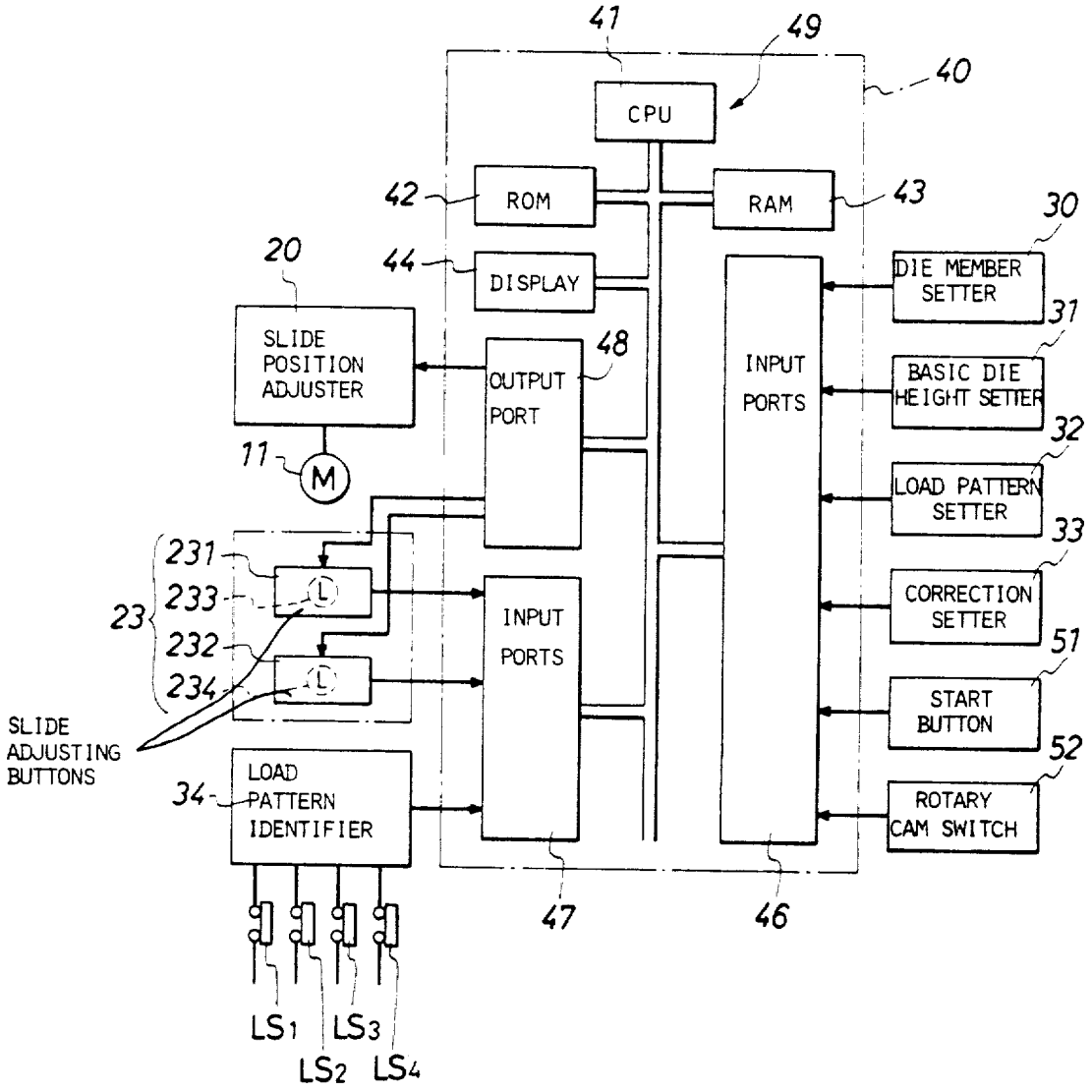
FIG. 1 is a block diagram showing the construction of the preferred embodiment of the invention.

As shown in FIG. 1, the automatic adjustment device of the invention comprises a load pattern setting means 32, a correction setting means 33, a pattern identification means 34 and a correction control means 49. When the slide is at a given position, i.e. top dead center, the slide adjustment button means 23 is turned ON (actuated) to operate a slide position adjustment unit 20 so as to rectify the position of the bottom of the slide at bottom dead center in the corresponding load pattern, thereby enabling an automatic adjustment of the slide to a constant die height to be performed.

To expand its use, the invention further includes a die code number setting means 30 by which an identification signal (die code number) is set (input) for each of the dies or group of dies used. Also included is a basic die height setting means 31. Reference numeral 40 in FIG. 1 designates a press control system for the entire machine, and its functions include a automatic adjustment of the die height. The press machine, including the slide, has the same structure as that shown in FIG. 5.

First, the press control system 40 will be described. CPU 41 is a central processing unit to which ROM 42, RAM 43, a display unit 44, input ports 46, 47, and an output port 48 are connected via buses. In the ROM 42, a drive control program for the entire press machine is stored. The display unit 44 may be a digital display or a CRT, and it displays a basic (set) die height, the current die height, the position of the bottom of the slide and the amount of correction. If a press start button 51 is depressed (turned ON), the press performs one pressing process (cycle), and the slide stops at the given position (the top dead center in the preferred embodiment). This is confirmed by a rotary cam switch 52.

The load pattern setting means 32 sets (inputs) possible load patterns in accordance with the number of dies under load. In the embodiment, it is formed as a digital switch, and the set patterns are stored in the RAM 43. Namely, in a press having plural dies aligned in a work transfer direction, the number of dies under load gradually increases during the starting operation (at the beginning of a run) while it gradually decreases during the stopping operation (at the end of the run). The change in the number of such dies will result in a change in the elongation of the press column, thereby changing the position of the slide at the bottom of its reciprocal movement (bottom dead center) and consequently the die height. Accordingly, the invention defines different load patterns, each corresponding to the number of dies under load, and sets the amount of correction for the die height in each load pattern.

Figure 2:
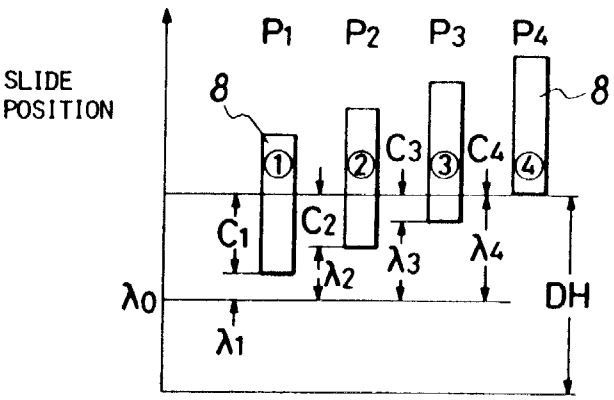
FIG. 2 is an explanatory drawing illustrating the relation between the position of the bottom of the slide and the amount of correction to be performed for each load pattern.
Figure 3:
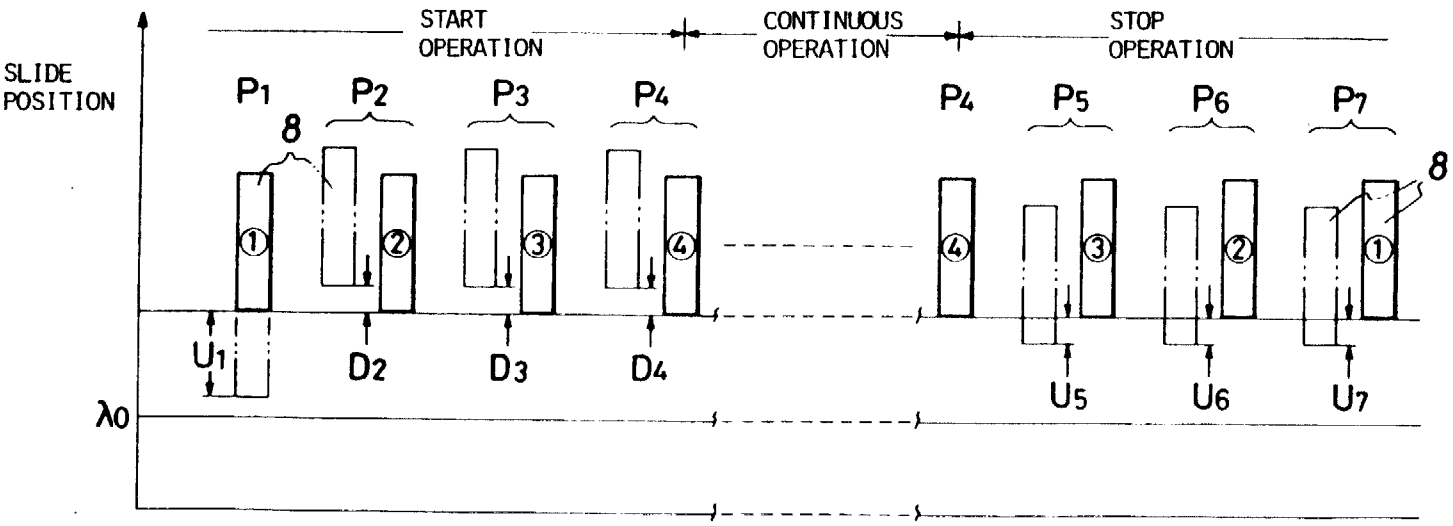
FIG. 3 is an explanatory drawing illustrating conditions before and after the die height adjustment.

Referring to FIGS. 2 and 3, the number shown encircled in the slide 8 represents the number of dies under load. For example, ① indicates one die subject to the press load. Using four dies, seven load patterns P1 to P7 are shown. P1 and P7 are the load patterns for one die under load during the starting and ending operations, respectively. Similarly, P2 and P6 are those for two dies, and P3 and P5 are for three. Defining the elongation of the unloaded press frame as $\lambda$ the elongation for the load patterns P1, P2, P3, P4 are respectively $\lambda 1$, $\lambda 2$, $\lambda 3$, $\lambda 4$, as shown in FIG. 2, so it is apparent that the position of the bottom of the slide at the bottom dead center is lowest in the load pattern P1 while highest in load pattern P4.

Although the numbers of dies under load in load patterns P1, P2, P3 are respectively the same as the numbers of dies under load in load patterns P7, P6, P5, the patterns are different in the positions of such dies. However, for the convenience of explanation, the elongation in the load patterns P1, P2, P3 is assumed to be the same as that in load patterns P7, P6, P5, respectively.

In the disclosed embodiment, the load pattern P4 is defined as a basic load pattern, and thus the corresponding position of the bottom of the slide (as effected by the elongation of the press during the continuous running of the press) is defined by a basic die height DH, the setting (inputting) of which is effected through the basic die height setting means 31, and which is stored in the RAM 43.

The correction setting means 33, which is formed as a digital switch, is the means for setting the amount of correction necessary to rectify the position of the bottom of the slide in each of the set load patterns to the basic slide bottom position, that is, the position of the bottom of the slide in the basic load pattern P4. (Alternatively, another load pattern may be defined as the basic load pattern.) The amounts of correction for the load patterns P1 to P4 are respectively the distances C1 to C4 shown in FIG. 2. The amounts of correction C1 to C4 are calculated as follows.

$$C1 = \lambda 4 - \lambda 1$$

$$C2 = \lambda 4 - \lambda 2$$

$$C3 = \lambda 4 - \lambda 3$$

$$C4 = \lambda 4 - \lambda 4 = 0$$

Upon confirming by the rotary cam switch 52 that the slide 8 is at the top dead center, the pattern identification means 34 identifies the current load pattern Pn with one of the possible load patterns P1 to P7 stored in RAM 43. This may be done automatically by the control program stored in the ROM 42. However, this embodiment uses grip-detecting limit switches LS1 to LS4 which are adapted to operate when the workpieces are held by grip fingers mounted to the feed bars for the respective dies, and the load pattern is determined on the basis of the combination of limit switches which detect the workpieces. For example, the load pattern is identified with P4 if all the four limit switches are closed.

When the slide adjustment button means 23 is turned ON or actuated, the correction control means 49, which in this embodiment includes the CPU 41, selectively reads out from the RAM 43 the proper amount of correction for the identified load pattern, and emits a corresponding signal as a drive control signal to the slide position adjustment unit 20.

Basically, the slide is controlled to move by the amount of correction Cn shown in FIG. 2. But because the number of dies under load gradually increases or decreases, the correction control means 49 is adapted to emit a drive control signal (U for the upward movement or D for the downward) corresponding to the difference between the position of the bottom of the slide in the current load pattern and the rectified position of the bottom of the slide in the former load pattern. In detail, the signal U1, corresponding to the load pattern P1, is the signal for moving the slide up by a distance equal to the amount of correction C1, as shown in FIG. 3. As the correction C1 is already effected, a drive control signal D2, corresponding to the load pattern P2, for moving the slide down by the amount C2 − C1 ($\lambda 1 - \lambda 2$) will be sufficient to correct the slide position for the load pattern P2. Consequently, in response to the signal D2, the slide position adjustment unit 20 should move the slide down by the distance corresponding to the difference between C2 and C1 (C1 − C2). Similarly, signals D3 and D4 are provided for signaling the unit 20 to move the slide down by distances corresponding to the differences (C2 − C3) and (C3 − C4), respectively. For the same reason, the load patterns P5 to P7 during the ending operation will lead to signals U5 to U7, respectively, for moving the slide upward.

Referring to FIG. 3 illustrating the starting to ending operations, the dotted line indicates the uncorrected position of the bottom of the slide at bottom dead center while the full line indicates the corrected one. As is the case with FIG. 2, the number of dies under load is proportional to the elongation as follows:

$$\lambda_2 = 2\lambda_1$$

$$\lambda_3 = 3\lambda_1$$

$$\lambda_4 = 4\lambda_1$$

As is described above, the correction control means 49 reads from the RAM 43 the amount of correction C1 to C4 set (input) by the means 33 and performs arithmetic calculations based on the program stored in the ROM 42 to emit signals U1, D2, D3, D4, U5, U6 and U7 at the appropriate times following corresponding pressing cycles. It may be possible, however, to pre-calculate the substantial distances of slide movement corresponding to said signals, input the distances through the correction setting means based on such calculations, and output the calculated amounts of correction (U1, D2, D3, D4, U5, U6, U7).

Figure 5:
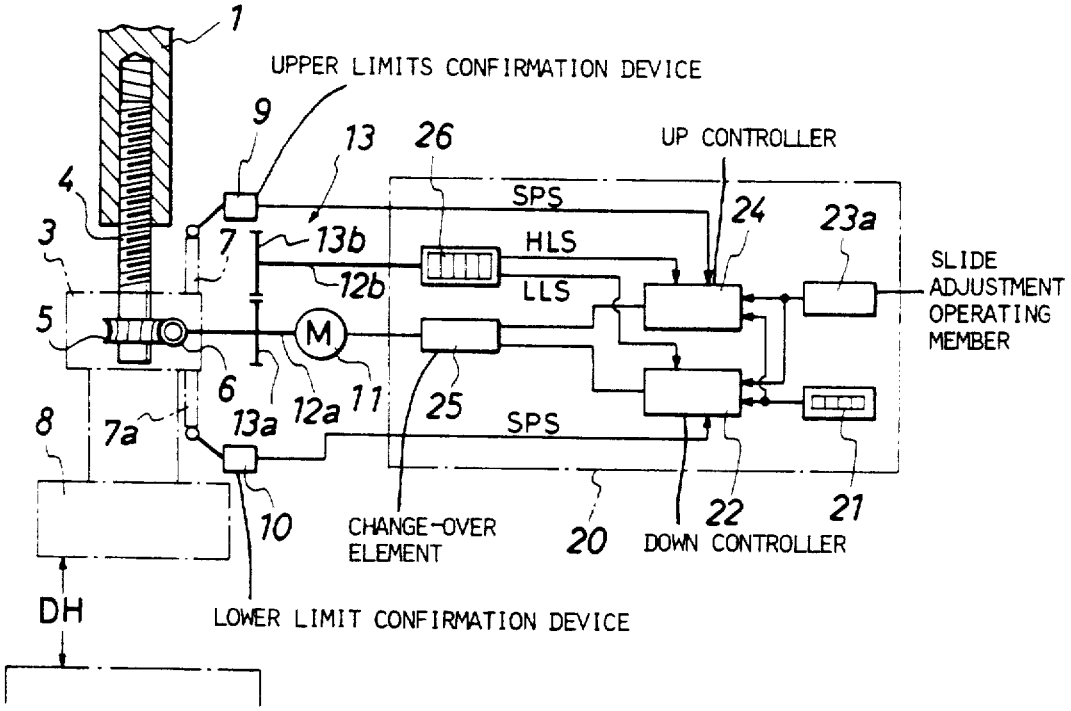
FIG. 5 PRIOR ART
FIG. 5 is a view showing a conventional slide position adjustment device.

Although the slide position adjustment unit 20 of the invention is basically the same as the structure shown in FIG. 5, it further includes a select switch, not shown, and is controlled by the signals (Un, Dn) from the correction control means 49 if the switch is selected for automatic adjustment. In other words, the slide adjustment button means 23*a* in FIG. 5 showing the prior art is for manual adjustment while that of the present invention is for automatic adjustment. The slide adjustment button means 23 of the invention may be also used for manual adjustment.

Figure 4:
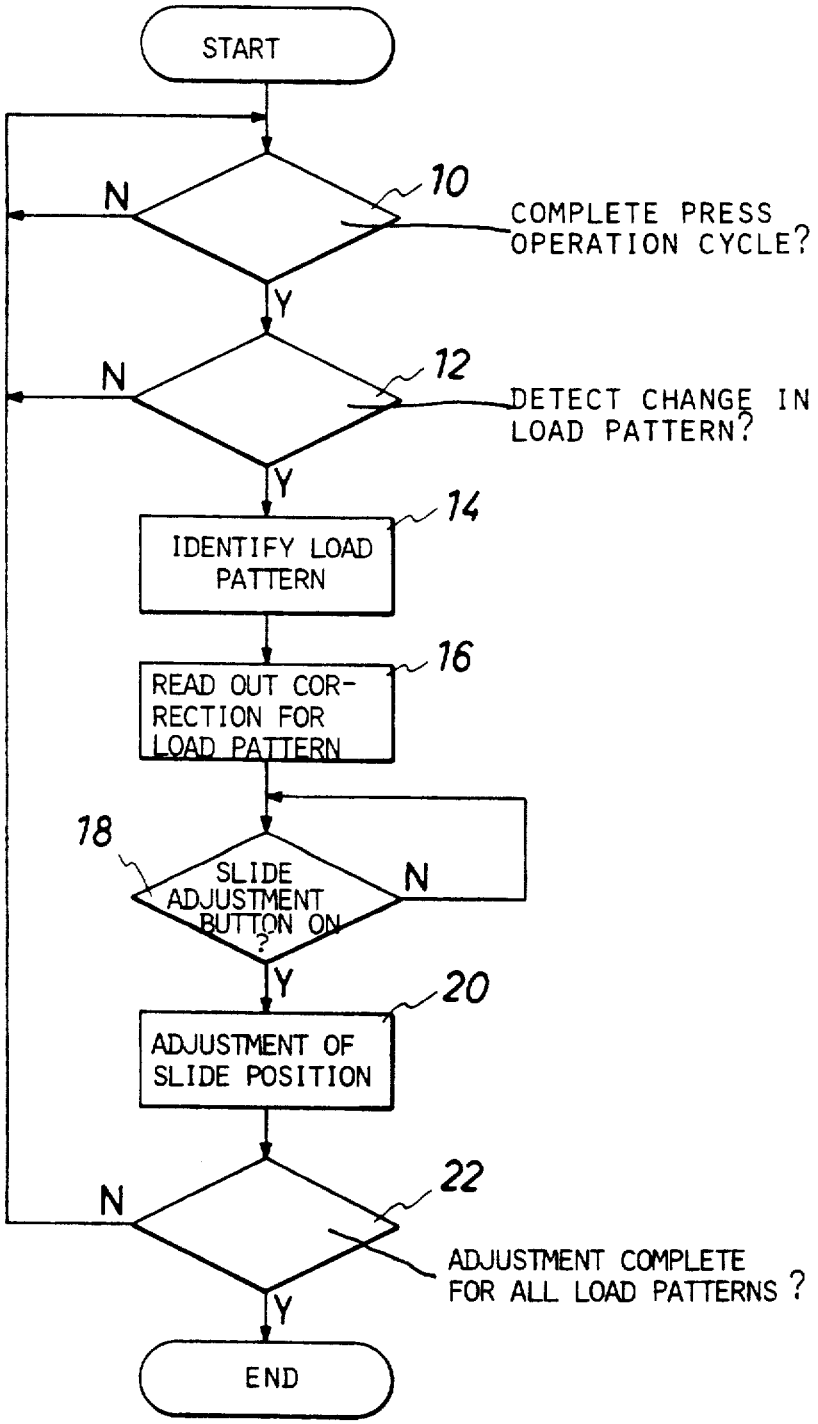
FIG. 4 is a flow chart of the operation of apparatus according to the invention.

As shown in FIG. 1, the slide adjustment button means (actuation means) 2 of the embodiment comprises an up button 231 and a down button 232, each incorporating a lamp (lamp 233 and lamp 234, respectively). When it is confirmed by the signal from the rotary cam switch 52 that the slide is at the given position, the CPU 41 lights the lamp 233 if the processed signal is for the upward signal Un, while it lights the lamp 234 in case of the downward signal Dn. Namely, before the automatic adjustment of the slide, the lighted lamp makes the operator aware again of whether an upward or downward movement is required and informs him which button should be pushed to actuate the slide position adjustment unit 20. The lamp flickers when the corresponding switch is in an operable condition, and it turns full on when the slide adjustment is completed. The slide adjustment button means 23 may be used also for manual adjustment as aforementioned or may omit the flickering operation. The program for automatic adjustment of the die height, as shown in FIG. 4, is stored in the ROM 42.

Further, in the illustrated embodiment the die number setting means provides means to cope with a change in the basic die height at a time of exchanging one group of dies for another corresponding to a change in the type of products to be formed. In other words, each group of dies used simultaneously, for which the basic die height, the load patterns and corresponding amount of correction are defined, has the same die number (identification number).

Next, the operation of the apparatus according to the invention will be described. Firstly, the setting (inputting) of data will be described. The die number (identification number) for the dies to be simultaneously used is set (input) in the die number setting means 30, and the basic die height is set (input) in the basic die height setting means 31. The die height for the load pattern P4, which has the greatest number of dies under load, is defined as the basic die height DH.

Subsequently, the pattern P1 is set (input) in the load pattern setting means 32, and then the corresponding amount of correction C1 is set (input) in the correction setting means 33. For patterns P2 and P3, the setting of the amount C2 and C3 is similarly effected. The correction for pattern P4 is zero. The correction data C5, C6, C7 stored for patterns P5, P6, P7 is automatically effected based on the data input for patterns P1, P2, P3.

The automatic adjustment of the die height will now be described with reference to FIGS. 1 and 4. A start button 51 for the press is pushed ON, whereupon the press performs a one-process operation (one cycle corresponding to, for example, a single reciprocal movement of the press), and the slide stops at the top dead center. Completion of the one-process operation is confirmed by a signal from the rotary cam switch 52 (see FIG. 4, Step 10). During this one-process operation, one workpiece is fed in the transfer direction to the first die. This workpiece is held by grip fingers mounted to a feed bar (not show in the figures).

Thus, the grip-detecting limits switch LS1 turns ON, whereby the change in the load pattern is detected (Step 12). Subsequently, the load pattern identification means 34 identifies the load pattern to be pattern P1 (Step 14).

At this time, the CPU 41 of the control system 40 reads out the correction C1 for the load pattern P1 based on the program for automatic adjustment of the die height stored in the ROM 42 (Step 16), and, at the same time, the CPU 41 processes the data in RAM 43 to calculate the distance by which the position of the bottom of the slide is to be rectified and outputs the corresponding signal U1. Then it flickers the lamp 233 so as to inform the operator of the direction which the slide must be adjusted and also that the slide is now ready to be adjusted. Thereafter, the slide adjustment button means 23 (231) is turned ON by the operator (Step 18), whereupon the signal U1 is sent via the output port 48 to the slide adjustment unit 20 (Step 20).

Then, the slide adjustment unit 20 moves the slide from the condition indicated by the dotted line to that shown by the full line in the position of FIG. 3 corresponding to the load pattern P1. Consequently, the die height for the pattern P1 has been automatically adjusted so that at bottom dead center, the slide bottom will reach the basic die height DH, whereupon the flickering lamp simultaneously adopts a fully lighted condition to indicate completion of the adjustment.

Thereafter, if all adjustments to the position of the bottom of the slide required during a run of workpieces have been made, the procedure ends (Step 22). Otherwise, the procedure will start again from the Step 10, followed by the pushing by the operator of the press start button 51 and the slide adjustment button 23 231, 232), whereby the position of the bottom of the slide at bottom dead center (the die height) is adjusted for the load patterns P2, P3, P4 and similarly for the load patterns P5, P6, P7 which belong to the ending operation of the press.

The embodiment comprises the pattern setting means 32, the correction setting means 33, the pattern identification means 34 and the correction control means 49 (including the CPU 41), wherein, upon operating the slide adjustment button means 23 (231, 232), the position of the bottom of the slide at the bottom dead center in each load pattern is automatically rectified to the basic die height by the slide position adjustment unit 20. Thus, even the workpieces run through the press during the starting and stopping operations can be formed into highly precise products, thereby reducing the production cost. This will directly speed up the process and improve productivity. The invention is very useful for a press by which a small quantity of various workpieces are pressed (inevitably, this type of press must often repeat the starting and stopping operations) or a press by which large-sized workpieces are pressed.

Other advantages of the invention are that the correction control means 49 may also serve for controlling the press drive, and that the slide position adjustment unit 20 does not require much modification from the conventional structure. Further, the load pattern identification means 34 comprises such grip-detecting limit switches LS that are in any case structurally required for the transfer press. Thus, the present invention will produce low-cost but high-precision articles.

Because the slide adjustment button means 23 has two buttons 231 and 232 for actuating upward and downward movement and comprises lamps 233 and 234 to inform the operator of the current condition, much safer and surer operations can be performed. Additionally, the provision of the die number setting means 30 enables automatic adjustment to the constant die height to be performed without the necessity of re-setting the basic die height when one or more dies are exchanged. This improves the usability of the invention when the press is used to produce a variety, but a small quantity, of articles.

Still further, because the invention permits the basic die height and the amount of correction for each load pattern to be easily reset, a trial pressing operation can be performed to obtain the practically optimum die height. Moreover, since the amount of correction is stored as fixed data in RAM 43, the invention does not require this data to be newly input and thus eliminates human errors incidental thereto.

It will be understood that the above description of the present invention is susceptible to various modifications, changes and adaptations, and the same are intended to be comprehended within the meaning and range of equivalents of the appended claims.

What is claimed is:

1. A device for adjusting die height in a press having plural dies disposed in a work transfer direction, comprising:

a slide position adjustment unit having means, responsive to an adjustment signal indicative of an amount of adjustment, and an actuation signal, for adjusting a position of a bottom of a slide for carrying the plural dies;

correction control means for controlling said slide adjustment unit;

a pattern setting means for inputting possible load patterns to said correction control means, each possible load pattern corresponding to a possible number of the dies under load during a pressing cycle of the press;

a correction setting means for inputting to said correction control means respective amounts of correction of the slide relative to a basic position of the bottom of the slide, the basic position corresponding to a basic load pattern selected from among the possible load patterns, the respective amounts of correction inputs by said correction setting means being required to rectify the positions of the bottom of the slide for the respective possible load patterns; and a pattern identification means for identifying from among the possible load patterns input by said pattern setting means the load pattern of the press when the slide is at a given position, and inputting to said correction control means a signal indicative of the identified load pattern;

said correction control means being responsive to the possible load patterns, the amounts of correction of the slide relative to the basic position of the bottom of the slide, and the identified load pattern of the press when the slide is at the given position, for selecting the proper amount of correction of the position of the bottom of the slide for the identified load pattern and emitting a drive control signal corresponding to said proper amount and constituting the adjustment signal;

whereby, for operation of the press in all of the possible load patterns, upon receipt by said slide position adjustment unit of the adjustment signal from said correction control means and the actuation signal, the slide position adjustment unit rectifies the position of the bottom of the slide so that tat the bottom dead center of a next pressing cycle of the press in the identified load pattern the die height is adjusted so as to be at same constant level for all of the possible load patterns.

2. A device as claimed in claim 1, wherein said pattern setting means and said correction setting means are each formed by a digital switch.

3. A device as claimed in claim 1, wherein the correction control means outputs the drive control signal corresponding to the difference between the position of the bottom of the slide, during a current pressing cycle when the slide reaches the given position, and a rectified position of the bottom of the slide following an adjustment by said slide position adjustment unit during the immediately preceding pressing cycle.

4. A device as claimed in claim 1, further comprising an actuation means which includes an up button and a down button, each incorporating a lamp, said actuation means being responsive to said adjustment signal for flickering the lamp of the up button when the adjustment signal indicates that an upward adjustment of the slide is required and for flickering the lamp of the down button when the adjustment signal indicates that a downward adjustment of the slide is required, the flickering button being responsive to being pushed to complete a transmission of the actuation signal to said adjustment unit, the lamp of the pushed button turning full on when the adjustment performed by the adjustment unit is completed.

5. A device as claimed in claim 1, wherein the press includes feed bars and grip fingers mounted to the feed bars, for gripping and feeding respective workpieces for each of the plural dies, said pattern identification means comprising means for identifying the load pattern when the slide is at the given position, based on the combination of grip fingers gripping workpieces and the possible load patterns input by the pattern setting means.

6. A device for adjusting die height in a press having a slide carrying a group of dies disposed in a work transfer direction, comprising:

a slide position adjustment unit having means, responsive to an adjustment signal indicative of an amount of adjustment, and an actuation signal, for adjusting a position of a bottom of a slide;

correction control means for controlling said slide adjustment unit;

a die identification signal setting means for inputting to said correction control means an identification signal identifying the group of dies carried by the slide;

a pattern setting means for inputting possible load patterns to said correction control means, each possible load pattern corresponding to a possible number of the dies under load during a pressing cycle of the press;

a basic die height setting means for inputting to said correction control means a basic die height for the identified group of dies carried by the slide, the basic die height being equal to a die height which corresponds to the position of the bottom of the slide when the slide is at the bottom dead center of a pressing cycle of the press with the load pattern being a predetermined one of the possible load patterns;

a correction setting means for inputting to said correction control means for each of the possible load patterns for the identified group of dies respective amounts of correction of the bottom of the slide relative to the basic die height required to rectify the position of the bottom of the slide; and a pattern identification means for identifying from among the possible load patterns input by said pattern setting means the load pattern of the press when the slide is at a given position, and for inputting to said correction control means a signal indicative of the identified load pattern;

said correction control means being responsive to the identified load pattern of the press when the slide is at the given position, the possible load patterns and the amounts of correction of the slide relative to the basic position of the bottom of the slide for the identified group of dies, for selecting the proper amount of correction of the position of the bottom of the slide for the identified load pattern and emitting a drive control signal to the slide position adjustment unit, the drive control signal corresponding to said proper amount and constituting the adjustment signal;

whereby, for operation of the press in all of the possible load patterns, upon receipt by said slide position adjustment unit of the adjustment signal from said correction control means and the actuation signal, the slide position adjustment unit rectifies the position of the bottom of the slide so that at the bottom dead center of a next pressing cycle of the press in the identified load pattern the die height is adjusted so as to be at a constant level relative to the basic die height for all of the possible load patterns.

7. A device as claimed in claim 6, wherein aid pattern setting means and said correction setting means are each formed by a digital switch.

8. A device as claimed in claim 6, wherein the correction control means outputs the drive control signal corresponding to the difference between the position of the bottom of the slide, during a current pressing cycle when the slide reaches the given position, and a rectified position of the bottom of the slide following an adjustment by said slide position adjustment unit during the immediately preceding pressing cycle.

9. A device as claimed in claim 6, further comprising an actuation means which includes an up button and a down button, each incorporating a lamp, said actuation means being responsive to said adjustment signal for flickering the lamp of the up button when the adjustment signal indicates that an upward adjustment of the slide is required and for flickering the lamp of the down button when the adjustment signal indicates that a downward adjustment of the slide is required, the flickering button being responsive to being pushed to complete a transmission of the actuation signal to said adjustment unit, the lamp of the pushed button turning full on when the adjustment performed by the adjustment unit is completed.

10. A device as claimed in claim 6, wherein the press includes feed bars and grip fingers mounted to the feed bars for griping and feeding respective workpieces for each die of the group of dies, said pattern identification means comprising means for identifying the load pattern when the slide is at the given position, based on the combination of grip fingers gripping dies and the possible load patterns input by the pattern setting means.

* * * * *